US006701719B1

(12) United States Patent
Lee

(10) Patent No.: US 6,701,719 B1
(45) Date of Patent: Mar. 9, 2004

(54) HEAT EXCHANGING DEVICE HAVING HIGH EFFICIENCY

(76) Inventor: Hsiang-Lung Lee, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/384,488

(22) Filed: Mar. 4, 2003

(51) Int. Cl.[7] ..... F25B 21/02
(52) U.S. Cl. ..... 62/3.5; 62/261
(58) Field of Search ..... 62/3.5, 3.6, 3.3, 62/261

(56) References Cited

U.S. PATENT DOCUMENTS 2,991,627 A * 7/1961 Suits ..... 62/3
3,136,577 A * 6/1964 Richard ..... 297/180
3,648,469 A * 3/1972 Chapman ..... 62/3
5,097,829 A * 3/1992 Quiesenberry ..... 128/400
5,524,439 A * 6/1996 Gallup et al. ..... 62/3.5
5,626,021 A * 5/1997 Karaunasiri et al. ..... 62/3.5
6,006,524 A * 12/1999 Park ..... 62/3.7
6,295,819 B1 * 10/2001 Mathiprakasam et al. .... 62/3.3
6,311,497 B1 * 11/2001 Chung ..... 62/3.3
6,523,354 B1 * 2/2003 Tolbert ..... 62/3.5

* cited by examiner

*Primary Examiner*—Melvin Jones

(57) ABSTRACT

A heat exchanging device having high efficiency includes a circulation heat exchanger, a water tank connected to the circulation heat exchanger and containing a fluid, a water pump mounted on the water tank for driving the fluid in the water tank into the circulation heat exchanger, a soft cushion connected to the circulation heat exchanger and the water tank, and a plurality of bypass pipes connected between the circulation heat exchanger, the water tank and the soft cushion, thereby forming a complete circulation circuit.

19 Claims, 8 Drawing Sheets

HEAT EXCHANGING DEVICE HAVING HIGH EFFICIENCY

BACKGROUND OF THE INVENTION

1. Field of the Invention

The present invention relates to a heat exchanging device having high efficiency, and more particularly to a heat exchanging device composed of plastic material having high efficiency, wherein the fluid completely flows through each of the heat exchanging fins in a circulating manner, so as to increase the heat exchanging period of the fluid with each of the heat exchanging fins, thereby enhancing the heat exchanging efficiency of the heat exchanging device.

2. Description of the Related Art

A conventional heat exchanging device comprises a cushion mounted on a seat, a bed or the like, and a heat exchanger connected to the cushion, so as to carry away the heat produced by the user seated on the cushion, thereby achieving the heat exchanging effect. The heat exchanger includes a plurality of heatsink fins arranged in parallel for passage of a fluid to achieve the heat exchanging effect. However, the heat exchanging effect of the parallel arranged heatsink fins is limited. In addition, the cushion has a fixed configuration, thereby decreasing the aesthetic quality of the conventional heat exchanging device.

SUMMARY OF THE INVENTION

The primary objective of the present invention is to provide a heat exchanging device having high efficiency, wherein the fluid completely flows through each of the heat exchanging fins in a circulating manner, so as to increase the heat exchanging period of the fluid with each of the heat exchanging fins, thereby enhancing the heat exchanging efficiency of the heat exchanging device.

Another objective of the present invention is to provide a heat exchanging device having high efficiency, wherein the soft cushion is modularized with a flexible feature, thereby enhancing the aesthetic quality of the heat exchanging device.

A further objective of the present invention is to provide a heat exchanging device having high efficiency, wherein the circulation heat exchanger, the water tank and the water pump are integrally received in a housing, so that the heat exchanging device is modularized with integrity, thereby enhancing the aesthetic quality of the heat exchanging device.

In accordance with the present invention, there is provided a heat exchanging device having high efficiency, comprising:

- a circulation heat exchanger;
- a water tank connected to the circulation heat exchanger and containing a fluid;
- a water pump mounted on the water tank for driving the fluid in the water tank into the circulation heat exchanger;
- a soft cushion connected to the circulation heat exchanger and the water tank; and
- a plurality of bypass pipes connected between the circulation heat exchanger, the water tank and the soft cushion, thereby forming a complete circulation circuit, wherein:
  - the circulation heat exchanger has an inside formed with a receiving space provided with a plurality of heat exchanging fins, the heat exchanging fins are arranged in a staggered manner, so that the fluid flows through each of the heat exchanging fins in a circulating manner, the circulation heat exchanger is formed with a water inlet and a water outlet each communicating with the receiving space.

Further benefits and advantages of the present invention will become apparent after a careful reading of the detailed description with appropriate reference to the accompanying drawings.

DETAILED DESCRIPTION OF THE INVENTION

Figure 1:
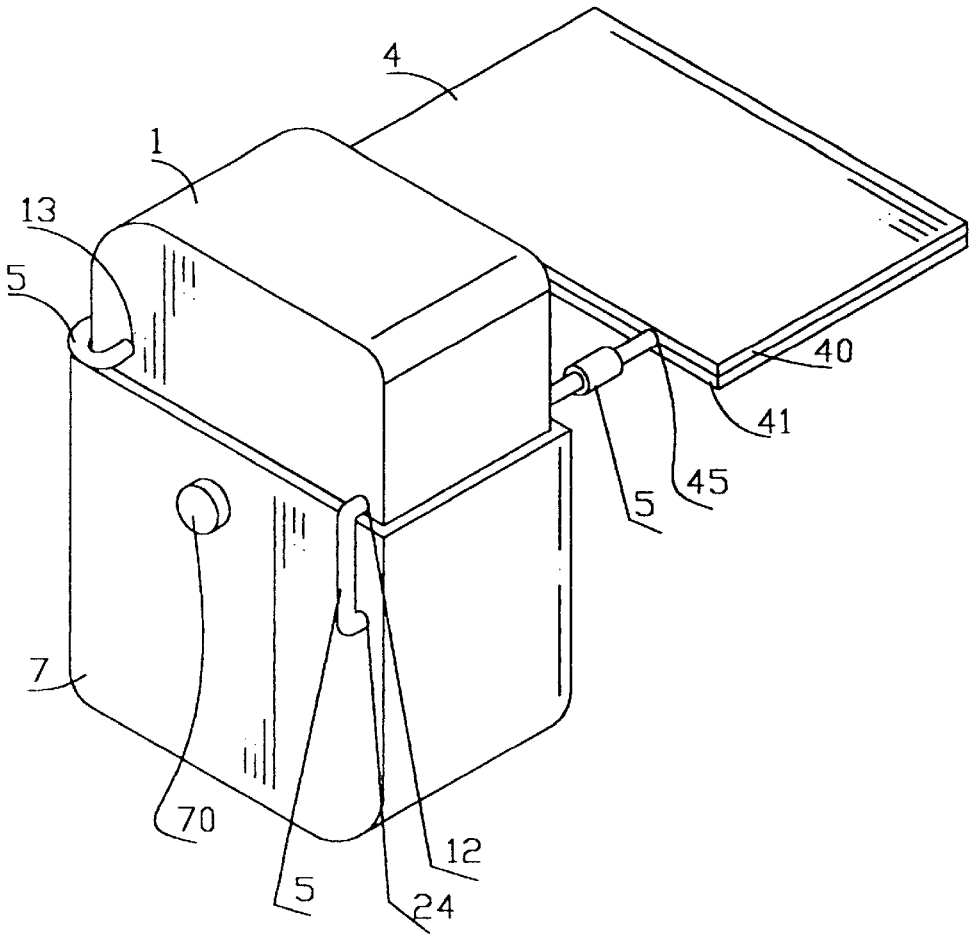
FIG. 1 is a perspective view of a heat exchanging device having high efficiency in accordance with the preferred embodiment of the present invention.

Referring to the drawings and initially to FIGS. 1–6, a heat exchanging device having high efficiency in accordance with the preferred embodiment of the present invention comprises a circulation heat exchanger 1, a water tank 2, a water pump 3, a soft cushion 4, a plurality of bypass pipes 5, and a fluid 6.

If necessary, the heat exchanging device further comprises a housing 7 for mounting the circulation heat exchanger 1, the water tank 2 and the water pump 3.

Figure 4:
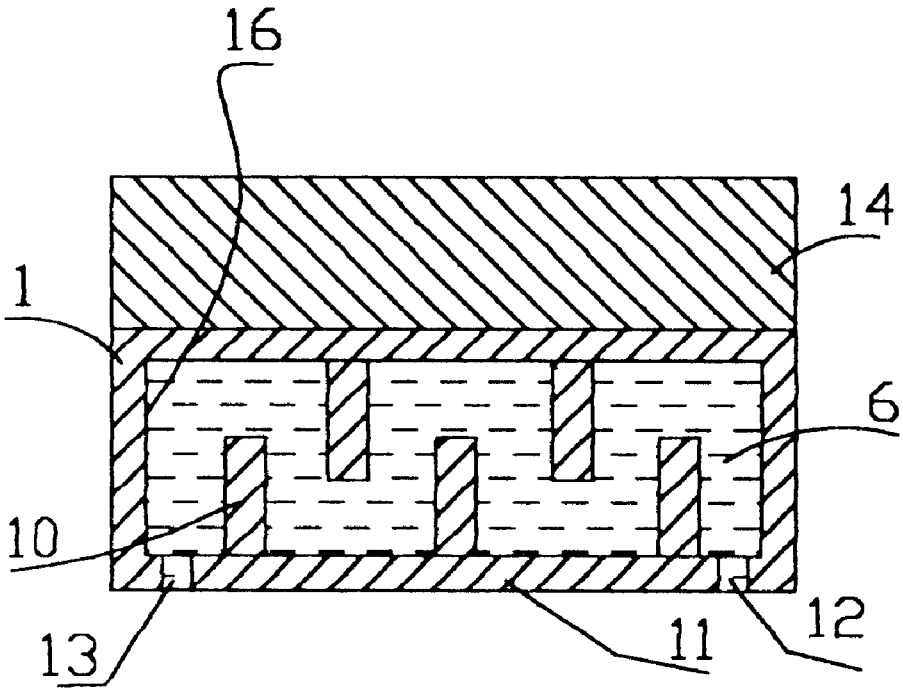
FIG. 4 is a top plan cross-sectional view of a circulation heat exchanger of the heat exchanging device having high efficiency as shown in FIG. 3.

Referring to FIG. 4, the circulation heat exchanger 1 is a closed box made of aluminum for receiving the fluid 6. The circulation heat exchanger 1 has an inside formed with a receiving space 16 provided with a plurality of heat exchanging fins 10 made of aluminum. The heat exchanging fins 10 are mounted on two opposite side walls 11 of the receiving space 16 of the circulation heat exchanger 1, and are arranged in a staggered manner, so that the fluid 6 completely flows through each of the heat exchanging fins 10 in a circulating manner, so as to increase the heat exchanging period of the fluid 6 with each of the heat exchanging fins 10. The circulation heat exchanger 1 is formed with a water inlet 12 and a water outlet 13 each communicating with the receiving space 16. The water outlet 13 of the circulation heat exchanger 1 is connected to the soft cushion 4 by the bypass pipe 5.

The heat exchanging device further comprises a ceramic thermoelectric chill chip 14 mounted on the circulation heat exchanger 1 for supplying the heat exchanging energy to the circulation heat exchanger 1. In addition, the circulation heat exchanger 1 can transfer the temperature of the flowing circulation fluid 6 of a large amount, thereby enhancing the operation efficiency of the heat transfer of the whole heat exchanging device.

Figure 5:
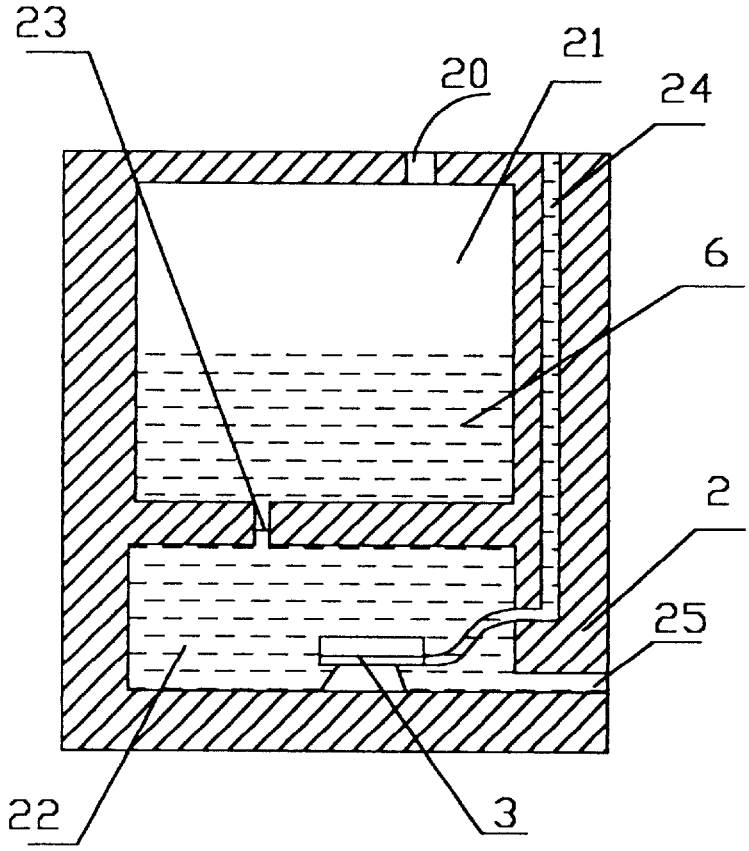
FIG. 5 is a side plan cross-sectional view of a water tank of the heat exchanging device having high efficiency as shown in FIG. 3.

Referring to FIG. 5, the water tank 2 has an inside formed with a larger chamber 21, a smaller chamber 22, and a connecting channel 23 connected between the larger chamber 21 and the smaller chamber 22. The water tank 2 is formed with a water filling port 20 communicating with the larger chamber 21 for filling the fluid 6 into the larger chamber 21. Thus, the flowing circulation fluid 6 is operated in the smaller chamber 22 of the water tank 2. In addition, the smaller chamber 22 of the water tank 2 is formed with a water outlet 24 and a water inlet 25. The water outlet 24 of the smaller chamber 22 is connected to the water inlet 12 of the circulation heat exchanger 1 by the bypass pipe 5. The water inlet 25 of the smaller chamber 22 is connected to the soft cushion 4 by the bypass pipe 5. Preferably, the water outlet 24 and the water inlet 25 of the smaller chamber 22 are located at different sides of the smaller chamber 22. Alternatively, the water outlet 24 and the water inlet 25 of the smaller chamber 22 are located at the same side of the smaller chamber 22.

When the soft cushion 4 is pressed by a foreign object, the flowing circulation fluid 6 can flow from the smaller chamber 22 through the connecting channel 23 into the larger chamber 21.

The water pump 3 is mounted in the smaller chamber 22 of the water tank 2. Alternatively, the water pump 3 is mounted outside of the water tank 2.

In operation, when the water pump 3 is operated by pressing a switch 70 mounted on the housing 7, the flowing circulation fluid 6 contained in the smaller chamber 22 of the water tank 2 is driven by the water pump 3 to flow through the water outlet 24 of the smaller chamber 22, the bypass pipe 5 and the water inlet 12 of the circulation heat exchanger 1 into the receiving space 16 of the circulation heat exchanger 1, so that the fluid 6 contained in the receiving space 16 of the circulation heat exchanger 1 is circulated and accelerated, thereby producing a heat exchanging function. After the heat exchanging action, the fluid 6 contained in the receiving space 16 of the circulation heat exchanger 1 flows through the water outlet 13 of the circulation heat exchanger 1 and the bypass pipe 5 into the soft cushion 4.

The bypass pipes 5 are connected between the circulation heat exchanger 1, the water tank 2 and the soft cushion 4, thereby forming a complete circulation circuit.

Figure 6:
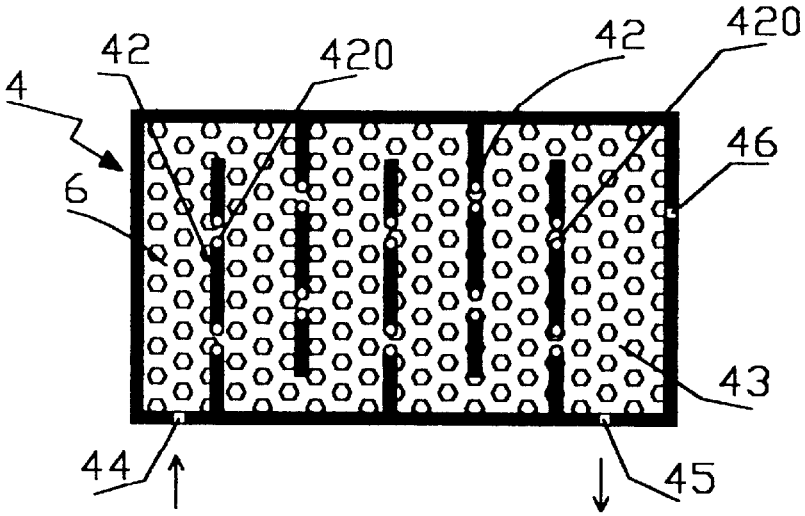
FIG. 6 is a top plan cross-sectional view of a soft cushion of the heat exchanging device having high efficiency as shown in FIG. 1.

Referring to FIGS. 1 and 6, the soft cushion 4 is made of soft material, such as PVC or the like. Preferably, the soft cushion 4 includes an upper cushion material 40, and a lower cushion material 41 laminated with the upper cushion material 40. In addition, the soft cushion 4 has an inner space 46 formed with a plurality of closure lines 42 arranged in a staggered manner, thereby forming a flow channel in the inner space 46 of the soft cushion 4 for circulation of the fluid 6. Each of the closure lines 42 is formed with two holes 420, thereby facilitating passage of the fluid 6. Most of the fluid 6 flows through the flow channel in the inner space 46 of the soft cushion 4 formed by the closure lines 42. When the soft cushion 4 is pressed locally, the fluid 6 can ass through the holes 420 of each of the closure lines 42, thereby preventing the fluid 6 from being choked in a specific region of the inner space 46 of the soft cushion 4. After the lower cushion material 41 is laminated with the upper cushion material 40, the lower cushion material 41 and the upper cushion material 40 are closely connected by high-frequency spotted closures 43, thereby forming the soft cushion 4. Thus, the fluid 6 flows through the flow channel in the inner space 46 of the soft cushion 4 smoothly and evenly.

In addition, the soft cushion 4 is formed with a water inlet 44 connected to the water outlet 13 of the circulation heat exchanger 1 by the bypass pipe 5 and a water outlet 45 connected to the water inlet 25 of the smaller chamber 22 by the bypass pipe 5.

Figure 2:
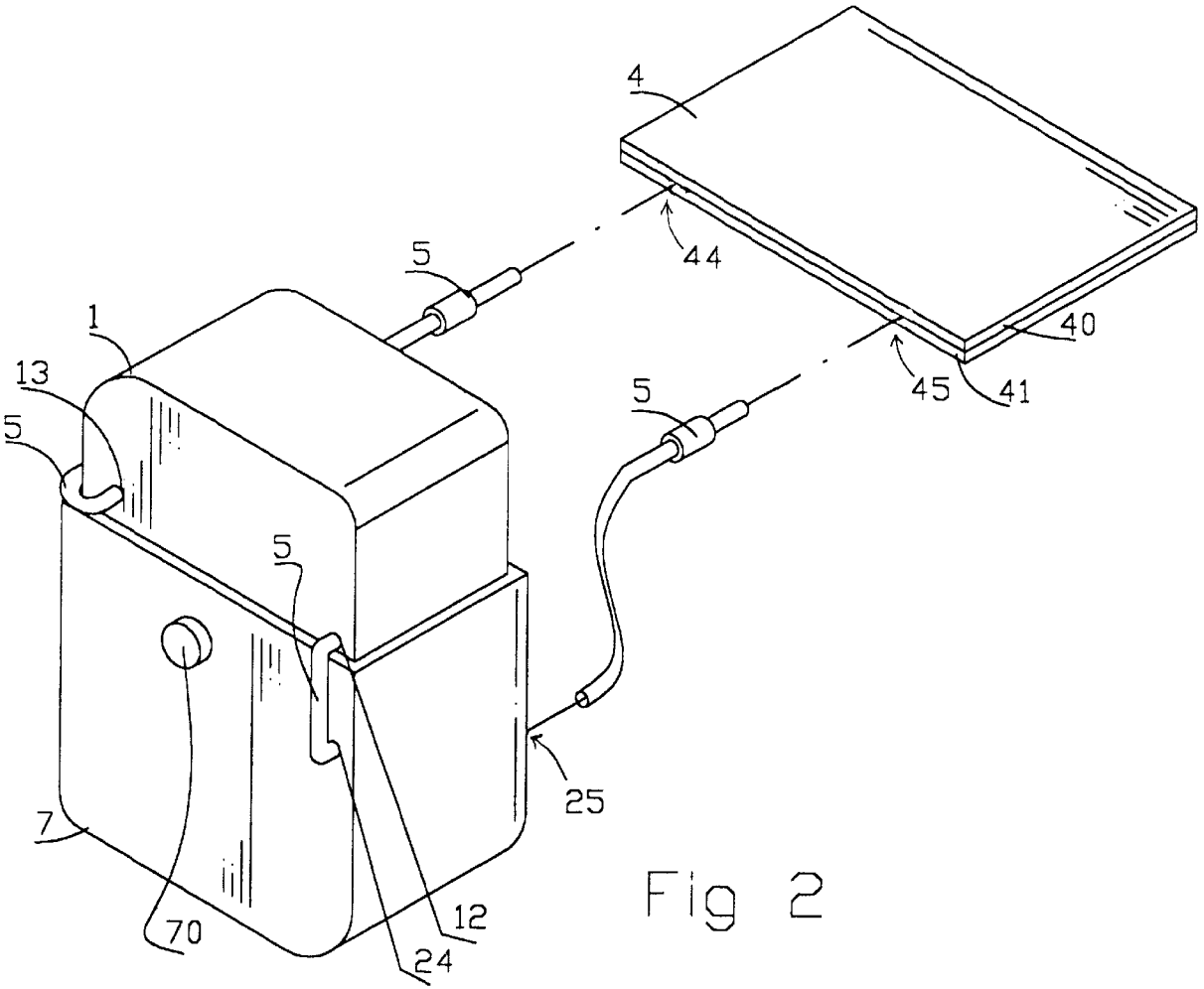
FIG. 2 is a partially exploded perspective view of the heat exchanging device having high efficiency in accordance with the preferred embodiment of the present invention.
Figure 3:
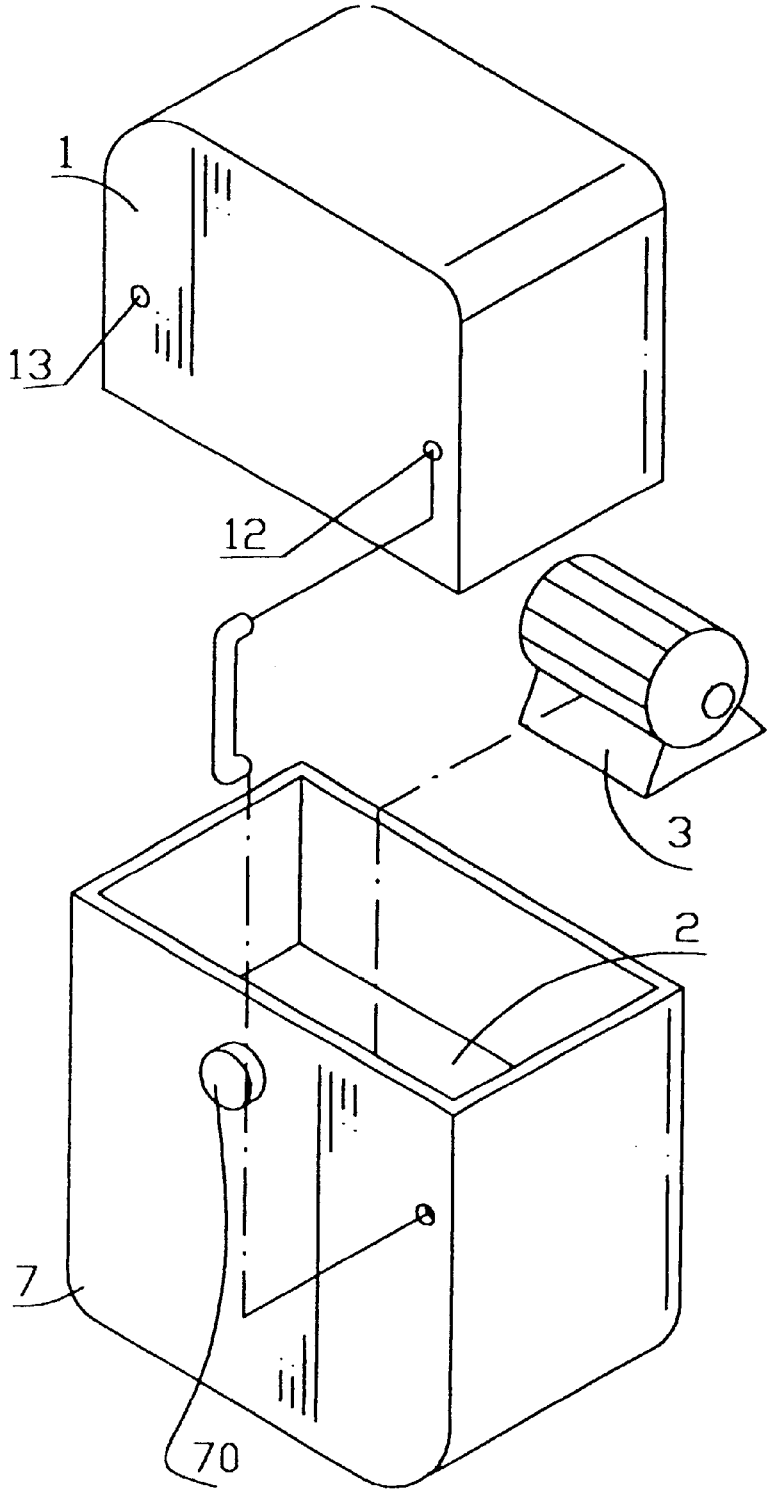
FIG. 3 is an exploded perspective view of the heat exchanging device having high efficiency in accordance with the preferred embodiment of the present invention.

As shown in FIG. 2, the water inlet 12 of the circulation heat exchanger 1 is connected to the water outlet 24 of the smaller chamber 22 by the bypass pipe 5, the water outlet 13 of the circulation heat exchanger 1 is connected to the water inlet 44 of the soft cushion 4 by the bypass pipe 5, and the water inlet 25 of the smaller chamber 22 is connected to the water outlet 45 of the soft cushion 4 by the bypass pipe 5.

Thus, the fluid 5 flows through the water outlet 13 of the circulation heat exchanger 1, the water inlet 44 of the soft cushion 4, the inner space 46 of the soft cushion 4, the water outlet 45 of the soft cushion 4, the water inlet 25 of the smaller chamber 22, the water tank 2, the water outlet 24 of the smaller chamber 22, the water inlet 12 of the circulation heat exchanger 1, the receiving space 16 of the circulation heat exchanger 1, and finally flows through the water outlet 13 of the circulation heat exchanger 1 again, thereby forming a complete heat exchanging circulation circuit. In such a manner, the fluid 6 passes through the soft cushion 4 so as to carry away the user's heat seated on the soft cushion 4, thereby achieving the heat exchanging effect.

Referring to FIG. 1, the housing 7 is arranged in an upright manner.

Figure 7:
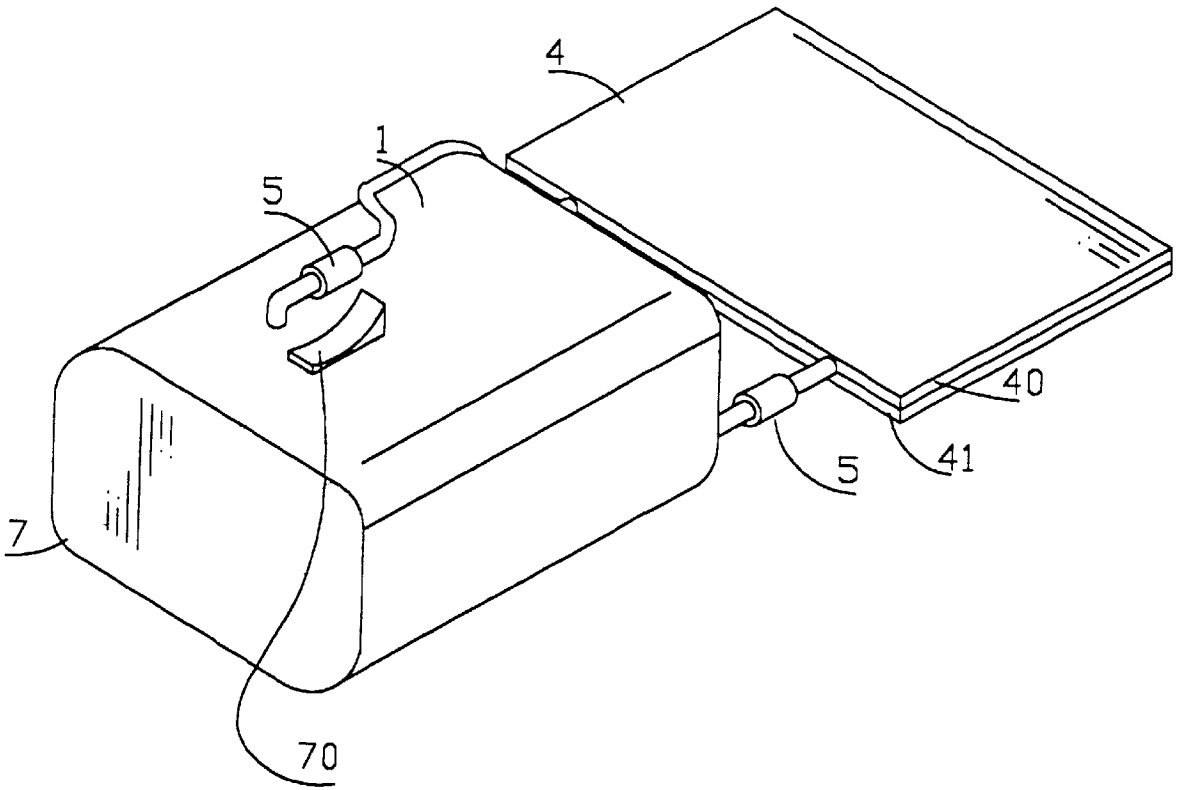
FIG. 7 is a perspective view of a heat exchanging device having high efficiency in accordance with another embodiment of the present invention.

Referring to FIG. 7, the housing 7 is arranged in a horizontal manner.

Figure 8:
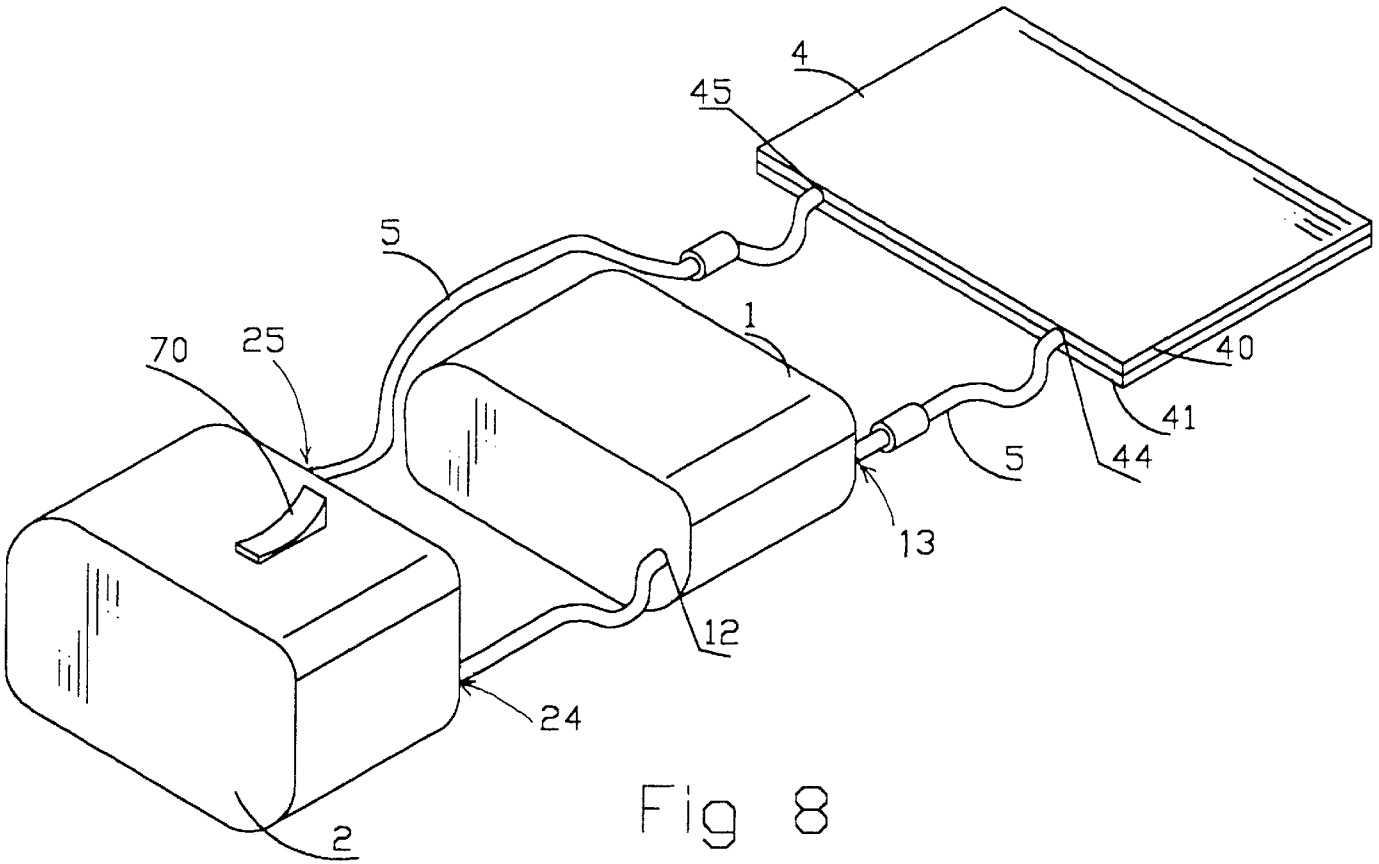
FIG. 8 is a perspective view of a heat exchanging device having high efficiency in accordance with another embodiment of the present invention.

Referring to FIG. 8, the housing 7 is undefined.

Figure 9:
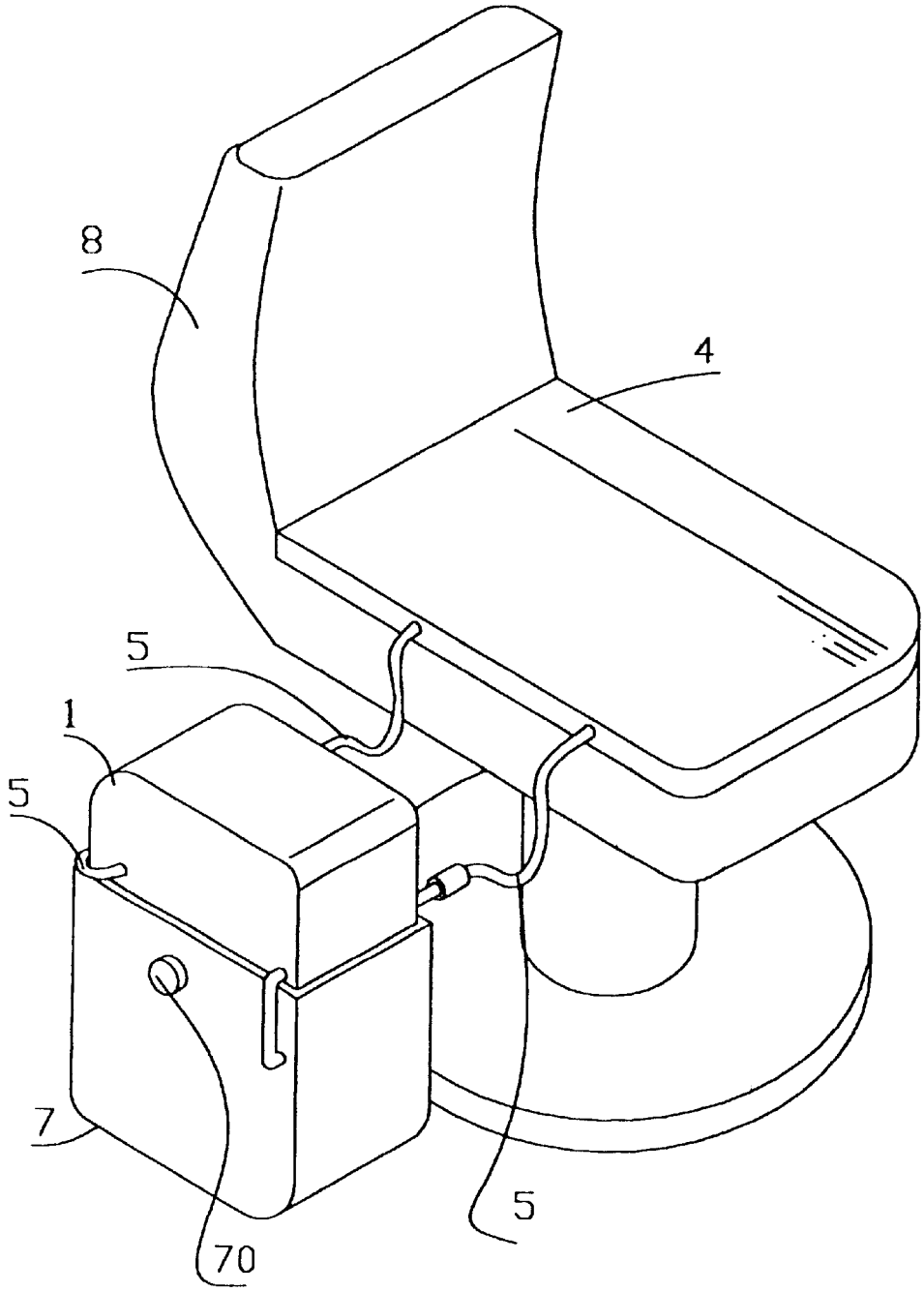
FIG. 9 is a perspective view showing use of the heat exchanging device having high efficiency in accordance with the present invention.

Referring to FIG. 9, the soft cushion 4 is mounted on a seat 8.

In operation, when the water pump 3 is operated, the fluid 6 contained in the smaller chamber 22 of the water tank 2 is driven by the water pump 3 to flow through the water outlet 24 of the smaller chamber 22, the water inlet 12 of the circulation heat exchanger 1, the receiving space 16 of the circulation heat exchanger 1 (to proceed the circulation action), the water outlet 13 of the circulation heat exchanger 1, the water inlet 44 of the soft cushion 4, the inner space 46 of the soft cushion 4 (to proceed the heat exchanging action), the water outlet 45 of the soft cushion 4, the water inlet 25 of the smaller chamber 22, and finally flows into the water tank 2, thereby accomplishing the complete heat exchanging circulation effect. In such a manner, the fluid 6 passes through the soft cushion 4 so as to carry away the heat produced by the user seated on the soft cushion 4, thereby achieving the heat exchanging effect.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A heat exchanging device having high efficiency, comprising:

a circulation heat exchanger;

a water tank connected to the circulation heat exchanger and containing a fluid;

a water pump mounted on the water tank for driving the fluid in the water tank into the circulation heat exchanger;

a soft cushion connected to the circulation heat exchanger and the water tank; and a plurality of bypass pipes connected between the circulation heat exchanger, the water tank and the soft cushion, thereby forming a complete circulation circuit, wherein:

the circulation heat exchanger has an inside formed with a receiving space provided with a plurality of heat exchanging fins, the heat exchanging fins are mounted on two opposite side walls of the receiving space of the circulation heat exchanger the heat exchanging fins are arranged in a staggered manner, so that the fluid flows through each of the heat exchanging fins in a circulating manner, the circulation heat exchanger is formed with a water inlet and a water outlet each communicating with the receiving space.

2. The heat exchanging device having high efficiency in accordance with claim 1, wherein the circulation heat exchanger is a closed box made of aluminum.

3. The heat exchanging device having high efficiency in accordance with claim 1, wherein the heat exchanging fins are made of aluminum.

4. The heat exchanging device having high efficiency in accordance with claim 1, further comprising a ceramic thermoelectric chill chip mounted on the circulation heat exchanger for supplying a heat exchanging energy to the circulation heat exchanger.

5. The heat exchanging device having high efficiency in accordance with claim 1, wherein the water tank has an inside formed with a larger chamber, a smaller chamber, and a connecting channel connected between the larger chamber and the smaller chamber, and the smaller chamber of the water tank is formed with a water outlet and a water inlet.

6. The heat exchanging device having high efficiency in accordance with claim 5, wherein the water tank is formed with a water filling port communicating with the larger chamber for filling the fluid into the larger chamber.

7. The heat exchanging device having high efficiency in accordance with claim 5, wherein the water outlet of the smaller chamber is connected to the water inlet of the circulation heat exchanger by one of the bypass pipes.

8. The heat exchanging device having high efficiency in accordance with claim 5, wherein the water outlet and the water inlet of the smaller chamber are located at different sides of the smaller chamber.

9. The heat exchanging device having high efficiency in accordance with claim 5, wherein the water pump is mounted in the smaller chamber of the water tank.

10. The heat exchanging device having high efficiency in accordance with claim 1, wherein the water pump is mounted outside of the water tank.

11. The heat exchanging device having high efficiency in accordance with claim 1, wherein the soft cushion includes an upper cushion material, and a lower cushion material laminated with the upper cushion material.

12. The heat exchanging device having high efficiency in accordance with claim 11, wherein the lower cushion material and the upper cushion material are connected by high-frequency spotted closures, thereby forming the soft cushion.

13. The heat exchanging device having high efficiency in accordance with claim 1, wherein the soft cushion has an inner space formed with a plurality of closure lines arranged in a staggered manner, thereby forming a flow channel in the inner space of the soft cushion for circulation of the fluid.

14. The heat exchanging device having high efficiency in accordance with claim 13, wherein each of the closure lines is formed with two holes, thereby facilitating passage of the fluid.

15. The heat exchanging device having high efficiency in accordance with claim 1, wherein the soft cushion is formed with a water inlet connected to the water outlet of the circulation heat exchanger by one of the bypass pipes.

16. The heat exchanging device having high efficiency in accordance with claim 5, wherein the soft cushion is formed with a water outlet connected to the water inlet of the smaller chamber of the water tank by one of the bypass pipes.

17. The heat exchanging device having high efficiency in accordance with claim 1, further comprising a housing for mounting the circulation heat exchanger, the water tank and the water pump.

18. The heat exchanging device having high efficiency in accordance with claim 17, wherein the housing is arranged in an upright manner.

19. The heat exchanging device having high efficiency in accordance with claim 17, wherein the housing is arranged in a horizontal manner.

* * * * *